US006535459B1

(12) United States Patent
Hutton et al.

(10) Patent No.: US 6,535,459 B1
(45) Date of Patent: Mar. 18, 2003

(54) BARREL STAVE PROJECTOR-STAVE ATTACHMENT

(75) Inventors: J. Stuart Hutton, Dartmouth (CA); Yolande R. M. Bonin, Nepean (CA)

(73) Assignee: Her Majesty the Queen in right of Canada, as represented by the Minister of National Defence in Her Brittanic Majesty's Government of the United Kingdom of Great Britain and Northern Ireland, Ottawa (CA)

( * ) Notice: Subject to any disclaimer, the term of this patent is extended or adjusted under 35 U.S.C. 154(b) by 0 days.

(21) Appl. No.: 10/124,304

(22) Filed: Apr. 18, 2002

(51) Int. Cl.[7] ..... H04R 17/00

(52) U.S. Cl. ..... 367/163; 367/174

(58) Field of Search ..... 367/163, 174, 367/158; 310/337; 181/110

(56) References Cited

U.S. PATENT DOCUMENTS

| | | | | |
|---|---|---|---|---|
| 4,922,470 A | | 5/1990 | McMahon et al. | |
| 5,136,556 A | | 8/1992 | Obara | |
| 5,757,728 A | * | 5/1998 | Tenghamn et al. | 367/163 |
| 5,805,529 A | * | 9/1998 | Purcell | 367/163 |

FOREIGN PATENT DOCUMENTS

EP 0 434 344 A2 6/1991

* cited by examiner

*Primary Examiner*—Ian J. Lobo
(74) *Attorney, Agent, or Firm*—Larson & Taylor, PLC

(57) ABSTRACT

An underwater acoustic projector comprising a pair of spaced apart end caps with an acoustic driver positioned between the end caps, the driver having smaller cross-sectional dimensions than the end caps to which the driver is mechanically coupled. The projector has a flextensional outer wall surrounding the driver with flanges at ends of that outer wall being secured to the end caps by a heat shrunk ring.

12 Claims, 6 Drawing Sheets

BARREL STAVE PROJECTOR-STAVE ATTACHMENT

FIELD OF THE INVENTION

The present invention relates to acoustic projectors, especially projectors for use in low frequency military and civilian sonar systems, and in particular to underwater acoustic projectors having a flextensional outer wall surrounding an acoustic driver with that outer wall being securely attached to end caps which are mechanically coupled to each end of the driver.

BACKGROUND OF THE INVENTION

Low frequency military and civilian sonar systems require compact, light weight, high power, efficient, wide bandwidth acoustic projectors whose performance is stable with depth and linear with drive voltage levels and which have a low manufacturing and maintenance cost.

Flextensional projectors are amongst the best ones presently available to meet the military and civilian sonar systems requirements, one of the most promising flextensional projectors being the barrel stave type. The barrel stave projector (BSP) is a compact, low frequency underwater sound source which has applications in low frequency active (LFA) sonar and in underwater communications. In one known BSP design, such as described in U.S. Pat. No. 4,922,470 by G. McMahon et al, a set of inwardly curved bars (staves) surround and enclose a stack of axially poled piezo-electric rings. The staves act like a mechanical transformer and help match the impedance of the transducer to the radiation impedance of the water. The staves are attached to octagonal end caps at each end of the stack by screws and epoxy glue. Axial motion of the stave ends is transformed to a larger radial motion of the stave midpoints. This increases the net volume velocity of the water, at the expense of the applied force, and is essential for radiating effectively at low frequencies.

This known BSP projector has slots between the staves which are required to reduce the hoop stiffness and achieve a useful transformer ratio. However, these slots must be waterproofed by a rubber membrane (boot) stretched tightly and glued with epoxy around the projector. This boot also provides effective corrosion protection for the aluminum staves.

Variants of this known BSP have been built to optimise light weight, wide bandwidth, low frequency, high power, and improved electroacoustic efficiency. Efficiency is an especially critical parameter for the high power versions of the BSP because the driver is well insulated from the water thermally. The boot's relatively poor thermal conductivity contributes to the difficulty in cooling the BSP.

The inside surfaces of the (eight) staves of one type of BSPs are machined individually from bar stock on a numerically controlled (NC) milling machine. The staves are then mounted together on a fixture and the outside surfaces are turned on a tracer lathe. Holes drilled in flanges at each end of the staves allow the staves to be connected to end caps by screws and glue. These BSPs are, as a result, both relatively costly to manufacture and maintain.

One variant of a BSP is described by Robert J. Obara in U.S. Pat. No. 5,136,556 where the barrel staves are arranged in a circle and are attached to octagonal end caps but have elliptical cross-sections of varying eccentricity between top and bottom end caps. This arrangement provides a wider bandwidth than with a circular (octagonal) cross-section arrangement throughout the length of the projector as in U.S. Pat. No. 4,992,470. The eight staves in U.S. Pat. No. 5,136,556 are attached to the upper and lower octagonal end caps by screws.

Another type of BSP is described in European Patent Application 90313788.3 by George H. Cavanagh III. In one embodiment in the European Patent Application, twelve staves are fastened to a dodecagon (a twelve-sided regular polygon) by means of screws (line 6 to 10 in column 5).

The use of screws to attach staves to end caps weakens the ends of the staves and creates stresses around holes through which the screws are inserted, particularly during operation when the staves are flexed to project acoustic waves.

A one-piece flextensional shell projector is described by Christopher Purcell in U.S. Pat. No. 5,805,529. The surface of this projector is formed of a thin-walled one-piece inwardly concavely shaped shell containing corrugations running in the axial direction. This one-piece shell is slotless which eliminates the requirement for a boot. End flanges on the one-piece shell are attached to end caps at each end of an acoustic driver by screws but these weaken the flanges and create stresses during operation which can result in fatigue in the metal flanges around the holes through which the screws are inserted.

SUMMARY OF THE INVENTION

It is an object of the invention to provide an acoustic projector with a secure attachment of a flextensional outer wall of the projector to end caps that are located at each end of an acoustic driver, the flextensional outer wall surrounding the driver.

An acoustic projector, according to one embodiment of the present invention, comprises a pair of spaced apart end caps with an acoustic driver positioned between and mechanically coupled to the end caps, the driver having smaller cross-sectional dimensions than the end caps, a flextensional outer wall of the projector surrounds the driver and is secured to the end caps by rings heat shrunk over outer end flanges on the outer wall, which flanges are in contact with the end caps.

BRIEF DESCRIPTION OF THE DRAWINGS

The invention will now be described in more detail with reference to the accompanying drawings, in which.

DESCRIPTION OF THE PREFERRED EMBODIMENTS

Low frequency military and civilian sonar systems require compact, light weight, high power, efficient, wide bandwidth acoustic projectors whose performance is stable with depth and linear with drive voltage levels as well as being low in cost to manufacture and maintain.

Figure 1:
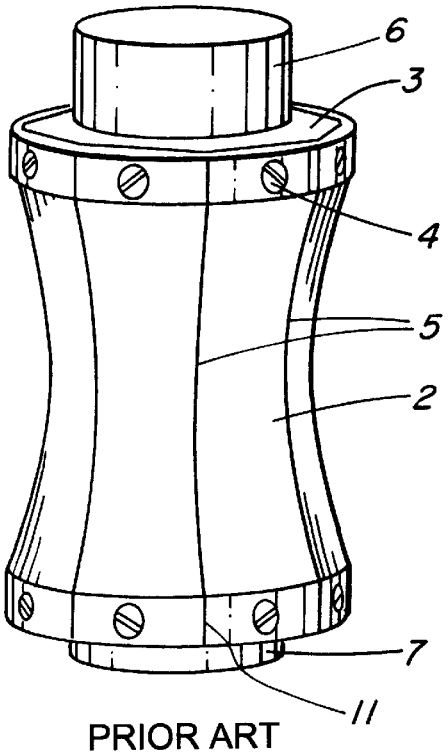
PRIOR ART FIG. 1
FIG. 1 is a perspective view of a known barrel-stave projector without a rubber boot.
Figure 2:
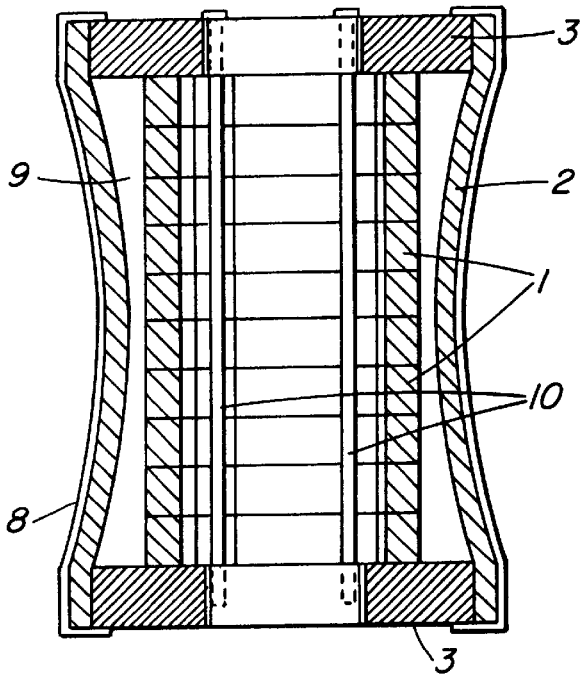
PRIOR ART FIG. 2
FIG. 2 is a cross-sectional view along a longitudinal axis of FIG. 1 with a rubber boot in place.

Flextensional projectors are amongst the best ones presently available to meet the requirements for military and civilian sonar systems. One type of flextensional projector, known as the barrel stave projector (BSP), is described in U.S. Pat. No. 4,922,470 by G. W. McMahon et al. This barrel stave projector, illustrated in FIGS. 1 and 2, contains a driver 1 (see FIG. 2) formed of a stack of axially poled piezoelectric ceramic rings and an enclosure formed by a set of inwardly curved bars (staves) 2 with polygonal end caps 3. The staves 2 are secured to flat sides of the octagonal end caps 3 with an adhesive (epoxy glue) and screws 4 retained in threaded holes in the end plates. Covers 6 and 7 with potting compounds seal openings in end plates 3.

Axial motion of the stave ends is transformed to a larger radial motion of the staves midpoints. Slots 5 between the staves 2 are required to reduce the hoop stiffness and achieve a useful transformer ratio. Those slots 5 must be waterproofed by a rubber membrane (boot) 8 that is stretched tightly around the projector and glued with epoxy. This boot 8 (shown in FIG. 2) is used for sealing purposes and may be formed of a rubber membrane such as neoprene which, for variants designed for operation near $1KH_z$, is about 1 mm thick. It also provides corrosion protection for the aluminum staves used in these types of BSPs.

Figure 3:
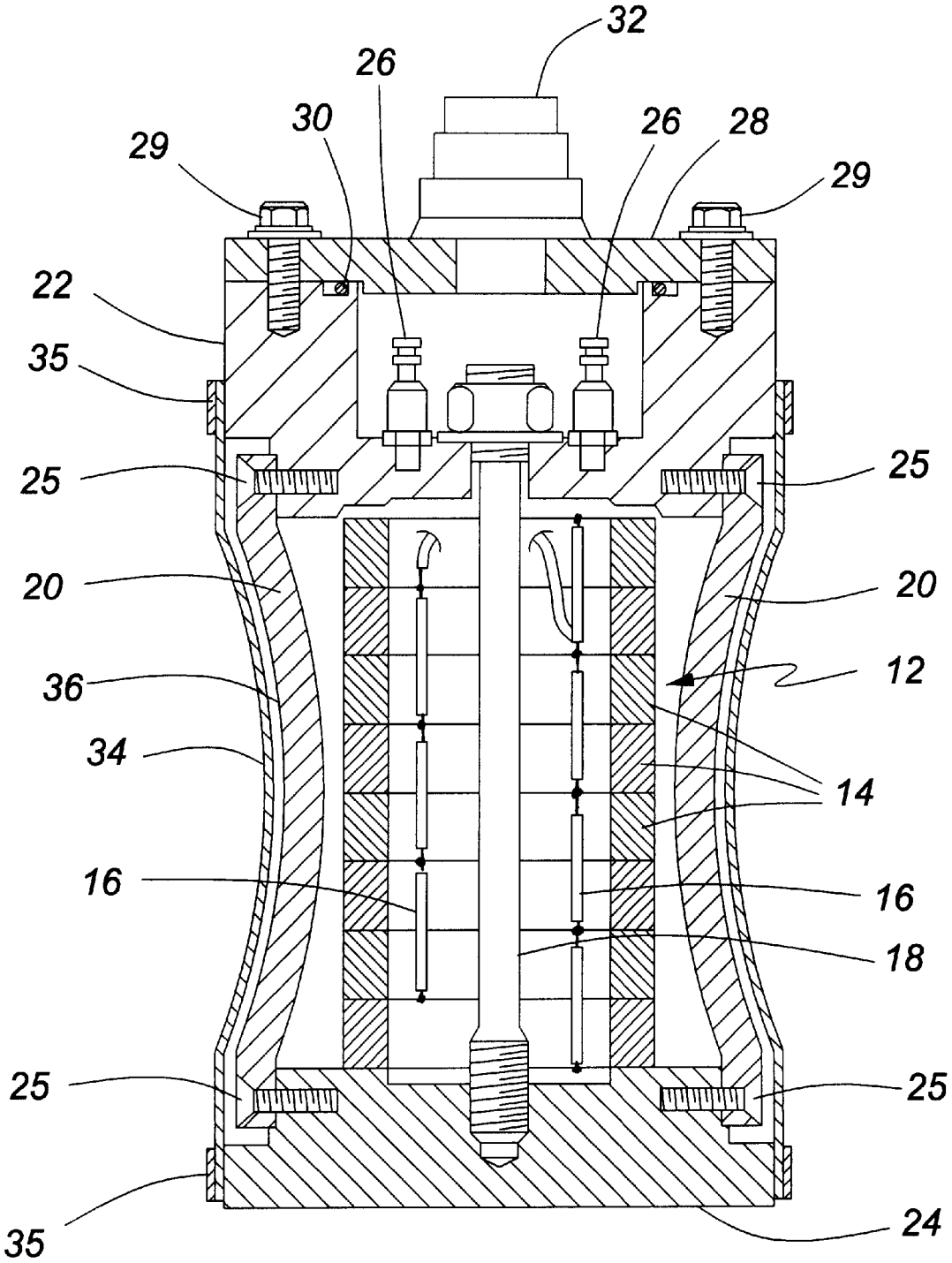
PRIOR ART FIG. 3
FIG. 3 is a cross-sectional view of another known barrel-stave projector.

One variant of a BSP is described by Robert J. Obara in U.S. Pat. No. 5,136,556 and is illustrated in FIG. 3. That projector has eight staves 20 attached to upper and lower octagonal end caps 22 and 24 by means of screws 25 with a stress bolt 18 passing through the center of a piezoelectric ceramic stack 12 being connected to the end caps to hold the elements in place (see lines 5 to 9 in column 2). The staves 20 in this projector are inwardly concavely bent along their length and form an hour glass shape with their ends at the end caps forming a circular shape but with the cross-section at the middle of the hour glass shape having an elliptical shape. Elliptical cross-sections of varying eccentricity appear along the length of the projector and this provides a wider bandwidth than in ones having only circular cross-sections.

Figure 4A:
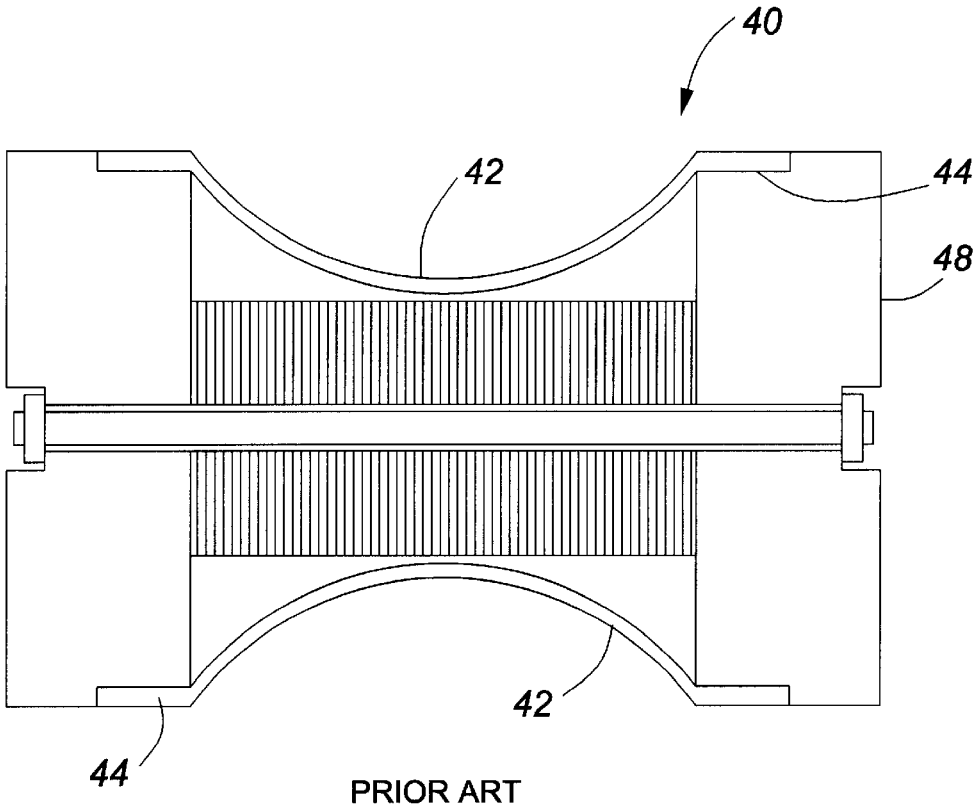
PRIOR ART FIG. 4A
FIG. 4*a* is a cross-sectional view of a further known barrel stave projector with FIG. 4*b* being a front view of one barrel stave for that projector.
Figure 4B:
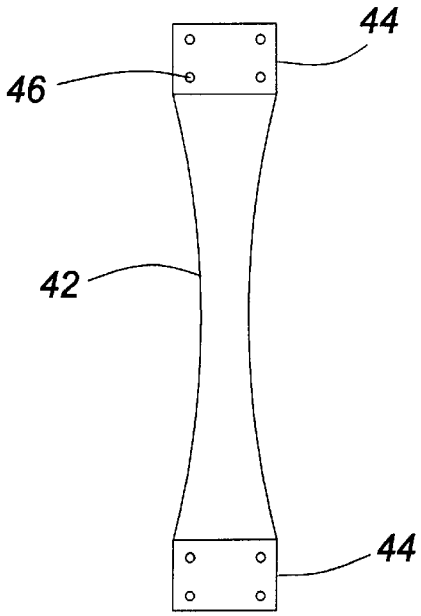
PRIOR ART FIG. 4B

Another variant of a BSP is described in European Patent Application 90313788.3 by George H. Cavanagh III. One embodiment of that variant is illustrated in the cross-sectional view of FIG. 4*a* with FIG. 4*b* being a front view of one of the staves 42. In this embodiment, flanges 44 at ends of twelve staves 42 are fastened to the end caps 48 by means of screws which are not visible in FIG. 4*a* but for which provision is shown in FIG. 4*b* (see lines 9 to 11 in column 5). The front view in FIG. 4*b* shows four holes 46 drilled into the end flanges 44 of stave 42 through which screws can be inserted to fasten the staves to the end caps 48.

Figure 5:
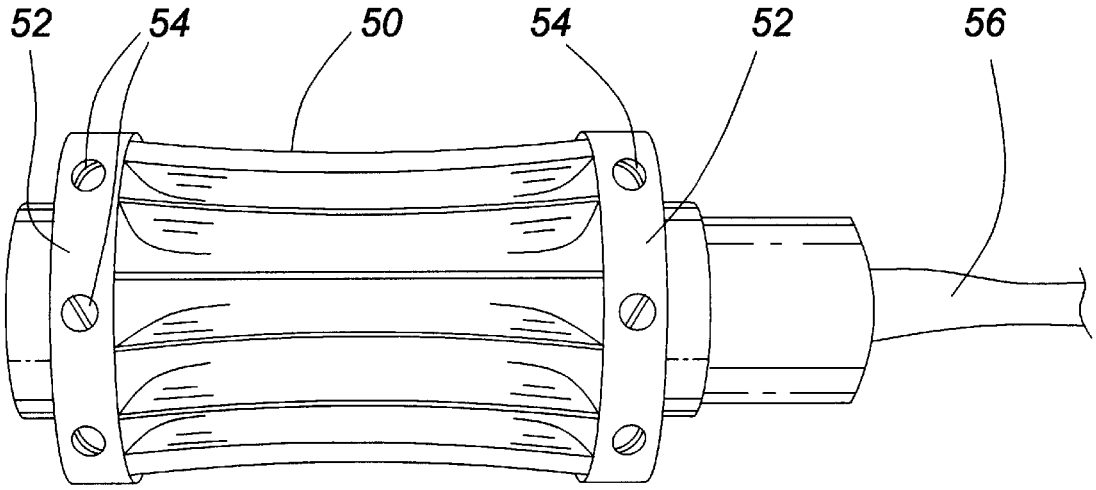
PRIOR ART FIG. 5
FIG. 5 is a perspective view of a known folded shell projector.

Another flextensional acoustic projector is described by Christopher Purcell in U.S. Pat. No. 5,805,529 and it is illustrated in FIG. 5. This projector has a one-piece slotless flextensional shell 50 that surrounds an acoustic driver (not shown). The shell 50 is inwardly concavely shaped similar to the BSP but this projector does not require any boot as the one-piece shell 50 and has no gaps, slots or openings in its outer surface. This shell 50 achieves the required low hoop stiffness for low frequency operation by using folds rather than slots as used in the ESP. This Folded Shell Projector's (FSP) surface is formed of a thin-walled one-piece inwardly concavely shaped metal shell 50 containing corrugations (folds) running in the axial direction. The thin-walled folded shell 50 is inwardly concavely shaped with a number of axially extending corrugations having valleys and ridges. The corrugations extend between end flanges 52 which are connected to end caps by screws 54. Leads 56 extend from the piezoelectric driver through a central opening in one of the end caps with potting compounds sealing that opening. The thin shell provides a waterproof enclosure for the driver in this type of projector.

Present method of attaching staves or outer flextensional shells to end caps in flextensional projectors rely on screws and/or glue. In many instances where epoxy glue is used, the glue is the principal holding mechanism but, in operation, shear stresses may exceed that which the glue can withstand and that attachment to the end caps fails leaving screws as the remaining holding mechanism. Excessive stresses can then occur in the staves or flextensional shell flanges around the holes drilled in the flanges during operation which may lead to fatigue failure around the holes and the attachment of flanges to the end caps. The use of screw holes in end flanges of staves or shell weakens the flanges, in particular, when a number of holes are used and if this is the principle attachment mechanism it may result in excessive stress around the holes during operation when the staves are flexing to project acoustic waves. The polygonal end plates (octagonal as in FIG. 1) on present barrel stave projectors create a number of machining steps which add to the costs of manufacturing the present type of barrel stave projectors (BSP).

The present invention eliminates the requirement for holes being drilled in end flanges of a flextensional outer wall of a flextensional acoustic projector and provides a more secure method of attaching that outer wall to end caps of the projector. Staves for a barrel stave projector to be attached to end caps according to the present invention are illustrated in the perspective view of FIG. 6A, top view of FIG. 6B and cross-sectional view of FIG. 6C.

Figure 6A:
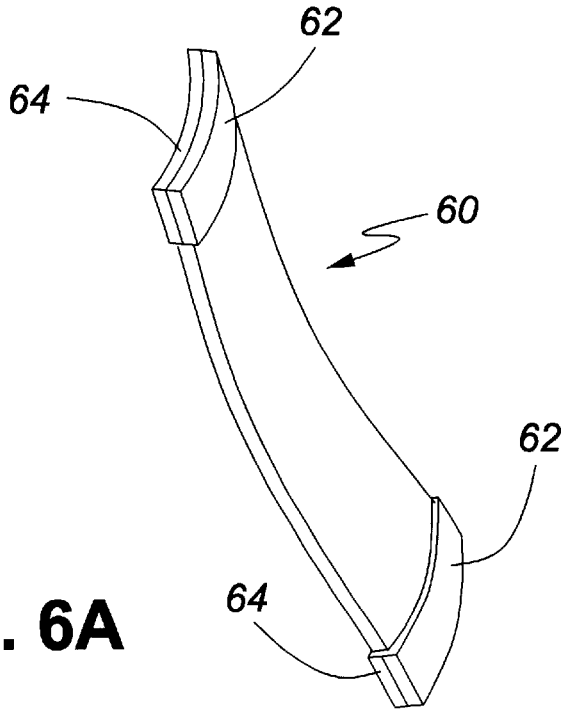
FIG. 6*a* is a perspective view of one stave for a barrel stave projector according to the present invention with FIG. 6*b* being a front view and 6c a cross-sectional view of that stave.
Figure 6B:
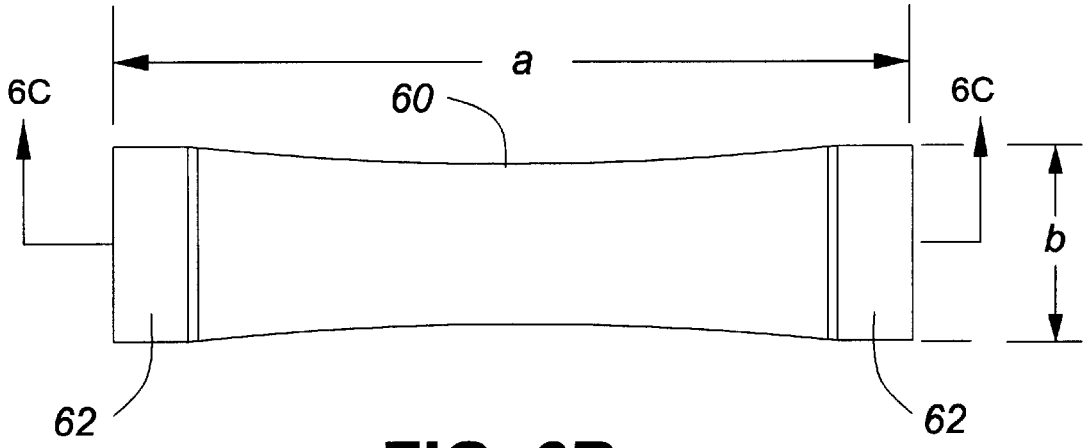
Figure 6C:
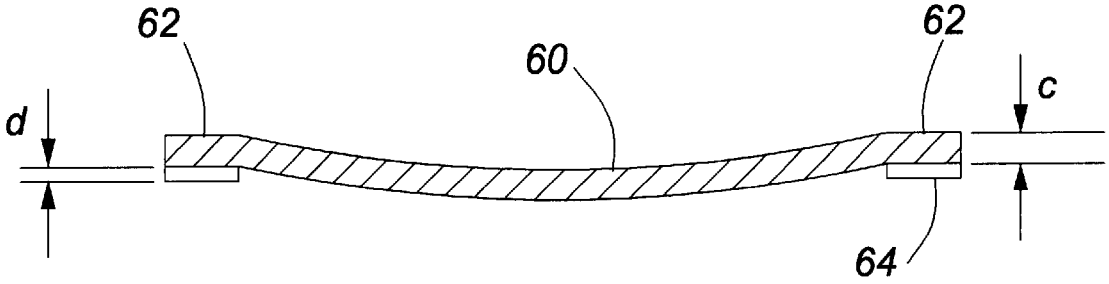

The stave 60 has an inwardly concave shape (when a number are assembled to form a BSP) as best illustrated in the cross-sectional view of the stave 60 shown in FIG. 6C and the perspective view of stave 60 in FIG. 6A. The radius r of an outer surface of stave 60 in this particular embodiment is 7.717 inches. The stave 60 has end flanges 62 with bosses 64 on the end flanges extending inwardly in the same direction as the concave curve, the bosses 64 having about the same outside dimensions as the flanges 62. The thickness "c" of the flanges 62 in this particular stave are 0.157 inches while the thickness "d" (see FIG. 6C) of the bosses 64 are 0.103 inches. The bosses 64 may be integrally formed with the end flanges 62 and inner surfaces of the bosses 62 are machined to have a curved inner surface (see FIG. 6A) that.will fit snuggly against edge surfaces of circular end caps 3' as best shown in FIG. 7B. The outer surface of end flanges 62 are machined to provide a curved outer surface that will fit against the inner surfaces of rings 66 that are to be heat shrunk against the end flanges 62 when the BSP is assembled. The round end caps 3' of this type of BSP require less machining steps to manufacture than octagonal ones 3 such as those in the known BSP shown in FIG. 1. This reduces the costs of manufacturing these types of BSPs.

The aluminum barrel stave 60 of the particular embodiment shown in FIG. 6B has a length "a" of 5.0 inches and the end flanges 62 have a width "b" of 1.199 inches. The width of the stave 60 at its central area is less than at the ends, each side of stave 60 being curved, so that the staves can be assembled next to each other in an assembled BSP. The inwardly concave shape of the outer sides of the staves, when assembled into a BSP as in FIG. 7A, requires the central area of each stave to have less width than the ends so that slots 5' between staves will have a generally constant width throughout the length of the projector when they are not being flexed by the acoustic driver.

Figure 7A:
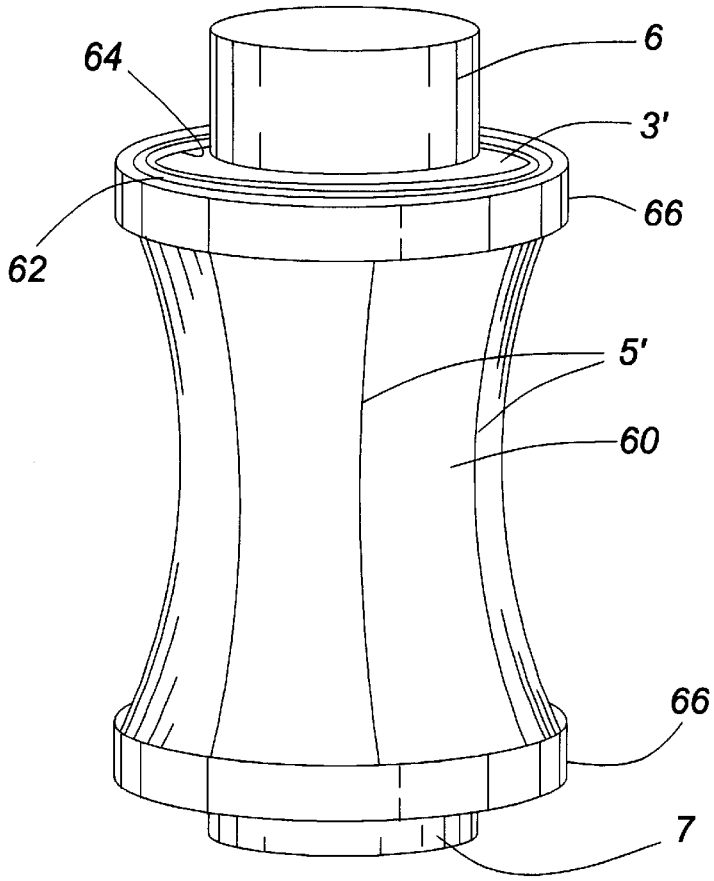
FIG. 7*a* is a perspective view of an acoustic. projector (a barrel-stave type) according to one embodiment of the invention.
Figure 7B:
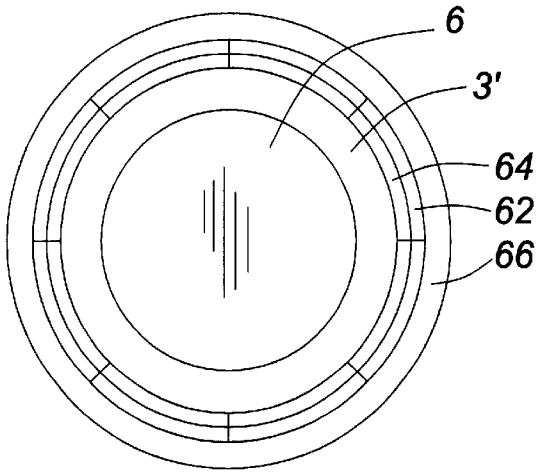
FIG. 7*b* is a top view of FIG. 7*a*.

To assemble the type of BSP, as shown in FIG. 7A, 8 barrel staves are arranged with their bosses 64 inner curved surface fitted around circular top and bottom (the bottom one not being shown in FIG. 7A) end caps 3'. The inner surfaces of bosses 64 may be glued to edges of end caps 3' or initially held in their assembled positions by mechanical means. Heated rings 66 are positioned over and around the curved outer surfaces of the top and bottom end flanges 62. The heated rings 66 will shrink against the end flanges 62 as they cool and securely fasten the staves 60 to the end caps 3'. In the particular embodiment illustrated in FIGS. 7A and 7B, the rings 66 and staves 60 are formed of 7075-T6 aluminum and the temperature range for heat shrinking rings 66 against end flanges 62 was to initially heat the rings 66 to between 370–450° C. before positioning the rings so they surround the end flanges 62. The assembly of this type of BSP where end flanges 62 of the staves 60 are secured to end caps by a heat shrunk ring 66 is simpler than using glue and screws as in known BSPs and less costly. It eliminates the need for glue since the compressive force of the heat shrunk ring produces a frictional force between the stave's end flanges 62 and the end caps greater than the shear stress of glues previously used. With the elimination of the requirement in the flanges for screws, the maximum stresses in the staves are evenly distributed and are lowered at their area of attachment to the end caps and this lowers the possibility of fatigue failure of the staves.

The embodiment described is for a BSP but the same type of attachment of an outer wall of other flextensional acoustic projector to end caps can be used such as in the known folded shell projector 50 shown in FIG. 5. This known folded shell projector 50 has end flanges of the one-piece inwardly curved corrugated shell attached to end caps by screws 54. Those end flanges could, however, be more securely attached to the end caps by heat shrunk rings with the elimination of any requirement to use screws.

Various modifications may be made to the preferred embodiments without departing from the spirit and scope of the invention as defined in the appended claims.

The embodiments of the invention in which an exclusive property or privilege is contained is claimed are defined as follows:

1. An acoustic projector comprising a pair of spaced apart end caps with an acoustic driver positioned between and mechanically coupled to the end caps, the driver having smaller cross-sectional dimensions than the end caps, a flextensional outer wall of the projector surrounds the driver and is secured to the end caps by rings heat shrunk over outer end flanges at each end of the outer wall, which flanges are in contact with the end caps.

2. An acoustic projector as defined in claim 1, wherein the flextensional outer wall is inwardly concavely shaped and formed by a circular arrangement of a number of concavely shaped barrel staves separated by slots, outer flanges of the barrel staves having curved inner surfaces that snuggly fit against circular outer edges of the end caps, flanges on the barrel staves having curved outer surfaces that fit against the inner surface of the rings that are heat shrunk over the flanges.

3. An acoustic projector as defined in claim 1, wherein the flextensional outer wall is inwardly concavely shaped and formed by a circular arrangement of a number of concavely shaped barrel staves separated by slots, outer flanges of the barrel staves having an inwardly extending boss, inner surfaces of the bosses being curved to fit snuggly against circular outer edges of the end caps, the barrel stave flanges having curved outer surfaces that fit against the inner surface of the rings which are heat shrunk over the flanges.

4. An acoustic projector as defined in claim 2, wherein a waterproof boot is stretched against outer surfaces of the barrel staves and is attached to the projector in a waterproof manner.

5. An acoustic projector as defined in claim 3, wherein edges of the barrel staves are concavely shaped and have a smaller width at the middle portion to allow assembly of the barrel staves in a circular arrangement with the width of the slots between the barrel staves being generally constant throughout the barrel staves length when in a relaxed state.

6. An acoustic projector as defined in claim 5, wherein a waterproof boot is stretched against outer surfaces of the barrel staves and is attached to the projector in a waterproof manner.

7. An acoustic projector as defined in claim 1, wherein the flextensional outer wall is an inwardly concavely shaped one-piece shell having axially extending corrugations, the end flanges being circular and fit against circular edges of the end caps and against the inner surfaces of the rings heat shrunk over the flanges.

8. An acoustic projector as defined in claim 2, wherein edges of the barrel staves are concavely shaped and have a smaller width at the middle portion to allow assembly of the barrel staves in a circular arrangement with the width of the slots between the barrel staves being generally constant throughout the barrel staves length when in a relaxed state.

9. A stave for a barrel stave projector comprising a concavely curved elongated portion with flanges at ends of the stave, the curved portion being inwardly concave shaped when a number of staves are assembled to form a barrel stave projector, the flanges on the staves having curved inner surfaces that are shaped to fit snuggly against circular outer edges of end caps for the acoustic projector and curved outer surfaces that are shaped to fit against an inner surface of a heat shrunk ring in an assembled projector.

10. A stave for a barrel stave projector as defined in claim 8, wherein edges of the elongated portion are concavely curved inwardly to the center axis of the elongated portion with the width at the middle of the elongated portion being less than at the ends next to the flanges.

11. A stave for a barrel stave projector comprising a concavely curved elongated portion with flanges at ends of the stave, the curved portion being inwardly concave shaped when a number of staves are assembled to form a barrel stave projector, the flanges on the stave having a boss that extends inwardly on an assembled projector,.the bosses having curved inner surfaces that are shaped to fit snuggly against circular outer edges of end caps for the projector, outer surfaces of the flanges being curved and shaped to fit against an inner surface of a heat shrunk ring in an assembled projector.

12. A stave for a barrel stave projector as defined in claim 11, wherein edges of the elongated portion are concavely curved inwardly towards the center axis of the elongated portion with the width at the middle of the elongated portion being less than at the ends next to the flanges.

* * * * *

UNITED STATES PATENT AND TRADEMARK OFFICE

CERTIFICATE OF CORRECTION

PATENT NO. : 6,535,459 B1
DATED : March 18, 2003
INVENTOR(S) : Hutton et al.

It is certified that error appears in the above-identified patent and that said Letters Patent is hereby corrected as shown below:

Title page,
Item [73], Assignee, should read:
-- [73] Assignee: Her Majesty the Queen as Represented by the Minister of National Defence of Her Majesty's Canadian Government --

Signed and Sealed this

Twenty-third Day of September, 2003

JAMES E. ROGAN
*Director of the United States Patent and Trademark Office*